US005468128A

United States Patent [19]

Benalikhodja

[11] Patent Number: 5,468,128

[45] Date of Patent: Nov. 21, 1995

[54] SEALED PISTON PUMP

[75] Inventor: Karim Benalikhodja, Valence, France

[73] Assignee: IMAJE, Bourg les Valence, France

[21] Appl. No.: 157,382

[22] Filed: Nov. 23, 1993

[30] Foreign Application Priority Data

Nov. 27, 1992 [FR] France ..... 92 14333

[51] Int. Cl.[6] ..... F04B 17/00

[52] U.S. Cl. ..... 417/413.1; 92/93; 92/151

[58] Field of Search ..... 417/413.1; 92/93, 92/151, 98 R

[56] References Cited

U.S. PATENT DOCUMENTS

| | | | |
|---|---|---|---|
| 2,241,056 | 5/1941 | Chilton . | |
| 2,675,758 | 4/1954 | Hughes . | |
| 2,856,047 | 10/1958 | Firth | 92/93 |
| 2,928,426 | 3/1960 | Taylor . | |
| 3,092,032 | 12/1960 | Bentzinger . | |
| 4,495,947 | 1/1985 | Motycka | 417/413.1 |
| 4,832,582 | 5/1989 | Buffet | 417/413.1 |
| 5,055,857 | 10/1991 | Regnault | 417/413.1 |

FOREIGN PATENT DOCUMENTS

| | | |
|---|---|---|
| 0823680 | 1/1938 | France . |
| 1412473 | 8/1965 | France . |
| 1432594 | 2/1966 | France . |
| 7103002 | 10/1971 | France . |
| 8718127 | 6/1989 | France . |
| 1231584 | 7/1967 | Germany . |
| 3813500 | 11/1989 | Germany . |

*Primary Examiner*—Charles Freay
*Attorney, Agent, or Firm*—Roland Plottel

[57] ABSTRACT

A sealed piston pump having in an open cavity of the pump body, a circular single-piece set formed by a central cylindrical piston. The piston is coupled by a rod to a driving member while the piston in an alternating motion along its longitudinal axis. A ring is placed on the pump body which is hollowed out with an annular channel and a deformable thinned part connecting the piston to the ring. The single-piece set and the pump body are fixedly joined to each other in an imperviously sealed way. The single-block set is made of a synthetic material that is flexible and mechanically and chemically resistant. The pump can be advantageously used in ink-jet printers.

10 Claims, 4 Drawing Sheets

SEALED PISTON PUMP

BACKGROUND OF THE INVENTION

1. Field of the Invention

The invention relates to a sealed piston pump wherein the liquid to be conveyed is drawn and then delivered to a chamber with variable volume under the effect of the alternating motion of a piston in this chamber and wherein the impervious sealing between the chamber of the pump and another chamber needs to be ensured. This sealing must be compatible with the movement of the pump elements such as the piston, and must be preserved despite chemical corrosion, if any, caused for example by the chemical nature of the fluid under certain conditions of temperature and pressure.

2. Description of the Prior Art

In a particular application to ink-jet printers, the diaphragm-fitted piston pump described in the U.S. Pat. No. 4,357,617 by K. K. Sharp has a large number of stacked parts necessary for the making of the assembly comprising the pump body, the piston and its sealing and fluid connection means. This approach is costly and unreliable owing to its constitution. Indeed, the diaphragms are jammed between, on the one hand, successive elements of a piston and, on the other hand, two flanges on the pump body, which may cause them to tear under difficult operating conditions.

To strengthen these diaphragms, the patents FR 71 03002, DE 1 231 584, FR 1 432 594 describe systems to support diaphragms in piston devices, such as concentric rings supported by the diaphragm on one side and by the moving control unit on the other side, said concentric rings sliding within one another. These systems are also ribs, fixedly joined to the piston, on which the diaphragm is supported. These systems are complicated to set up and ill-suited to application to ink-jet printers.

The drawback of using sealing diaphragms available in the market is related to their mode of manufacture which is generally done by the cutting out of a even chip on the periphery of a cylinder. This method leaves tool marks on the diaphragm thus made, fostering the creation of zones susceptible to tearing.

Furthermore, present-day piston pumps commonly have a metal piston whose walls get worn down in contact with the body of the pump, giving rise to filings that risk wearing out or clogging certain parts of the hydraulic circuit into which the pump is integrated.

The invention is aimed at overcoming these drawbacks by proposing a sealed piston pump of simple design while at the same time ensuring an optimum compression rate for the pump, irrespectively of the phase of the fluid conveyed, whether it is liquid (ink for example), gas or diphasic.

SUMMARY OF THE INVENTION

To this end, the invention proposes a piston-diaphragm-flange set, molded as one piece made of a synthetic material.

More specifically, the invention relates to a sealed piston pump comprising a pump body with an open cavity hollowed out in the center of one of its faces, at least two holes being pierced on said face, wherein said sealed piston pump furthermore comprises a circular single-piece set formed by:

a central cylindrical piston having dimensions substantially equal to those of the cavity, coupled by means of a rod to a driving member that drives in an alternating motion along its longitudinal axis, in the cavity between a low position defined by the bottom of the cavity and a high position defining a chamber with variable volume;

a ring, having dimensions substantially equal to those of the face of the pump body, there being positioned and hollowed, on the face of the ring opposite the pump body, an annular channel whose bottom is perforated at the position of the holes of the pump body;

a deformable thinned part, connecting the upper rim of the piston with the internal circumference of the ring and perfectly matching the shape of the neck of the cavity when the piston is in the low position;

and wherein the pump body and the single-piece set are fixedly joined in an imperviously sealed way.

According to another characteristic of the invention, the single-piece set may be made by the sintering of fine powders giving a homogeneous material that can be used to obtain a very high-quality, low-cost set when it is made in large batches. Preferably, the piston/diaphragm/flange single-piece set is made of polyethylene tetrafluoride, thus preventing problems of the wearing out of the piston since the shaping of this piston in the pump body is obtained essentially by hammering.

The simplicity of the assembly of the pump according to the invention reduces the risks of its defectiveness as well as its manufacturing costs.

BRIEF DESCRIPTION OF THE DRAWINGS

Other features and advantages of the invention shall appear from the following description of two particular exemplary embodiments, this description being made with respect to the appended drawings wherein.

The elements bearing the same references in these different figures fulfil the same functions with a view to obtaining the same results.

MORE DETAILED DESCRIPTION

Figure 1:
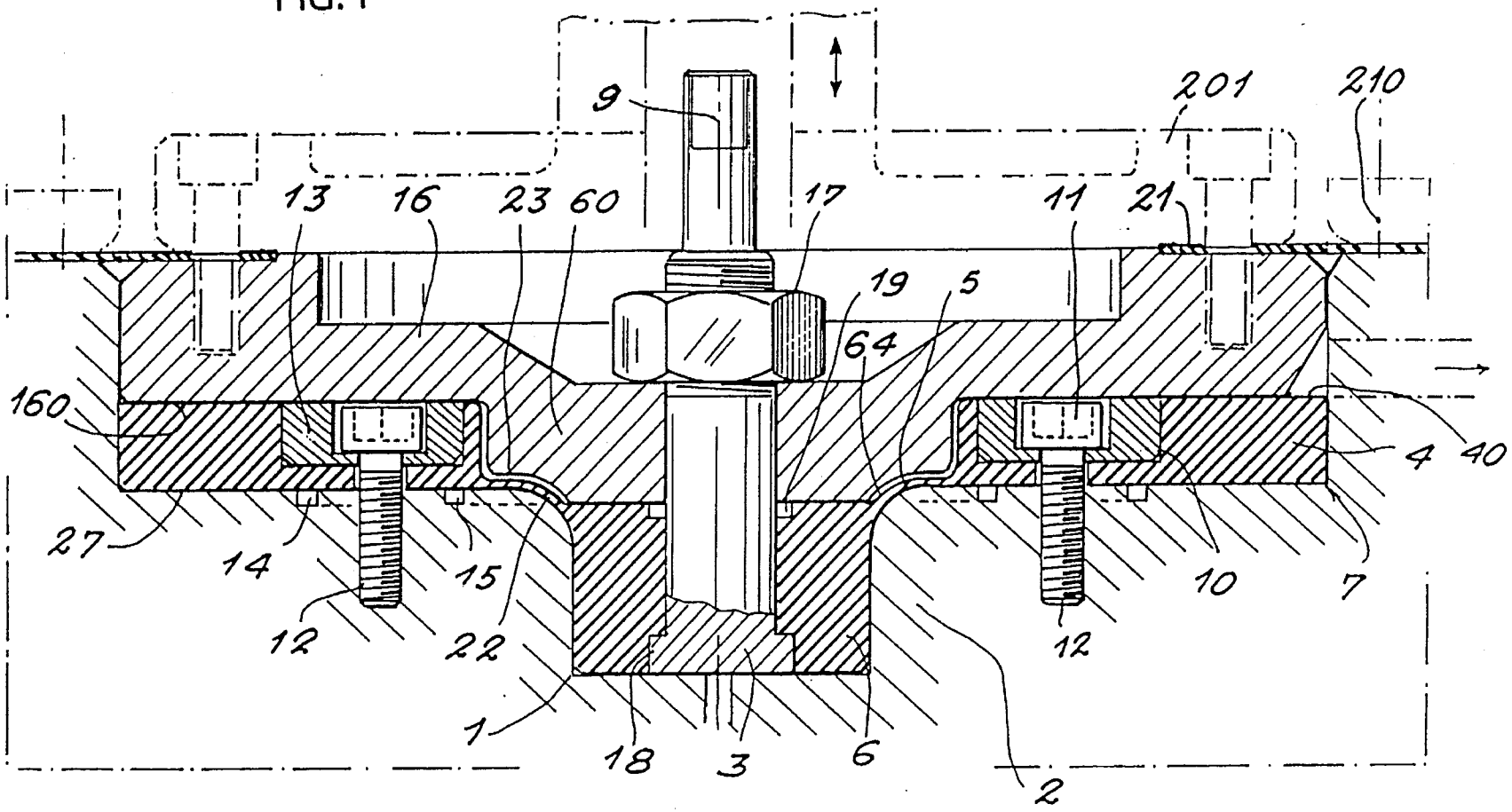
FIGS. 1 and 2 are cross-sectional views of a first embodiment of the pump body/piston set of a sealed pump according to the invention, in the two extreme positions of the piston.

The sealed piston pump according to the invention, such as is shown in FIG. 1 comprises a pump body 2 with an open cavity 1 hollowed out in the center of one of its faces 27. This cavity 1 is designed to receive a cylindrical piston, with dimensions substantially equal to those of the cavity 1. At least two holes 12 are pierced in the pump body, outside the cavity 1.

The pump also has a cylindrical piston 6 that forms an integral part of a circular single-piece set 7 that also includes a ring 4 designed to be placed on the face 27 of the pump body 2 and a deformable thinned part 5 connecting the upper rim 64 of the central piston 6 to the internal circumference of the ring 4. Said piston gets housed in the cavity 1 of the pump body 2. This single-piece set 7 is made of a flexible synthetic material that is resistant to chemicals and to friction. It is, for example, a material such as polyethylene tetrafluoride. The different parts of the set are obtained by machining or by the molding of thermocompressed powders.

Figure 2:
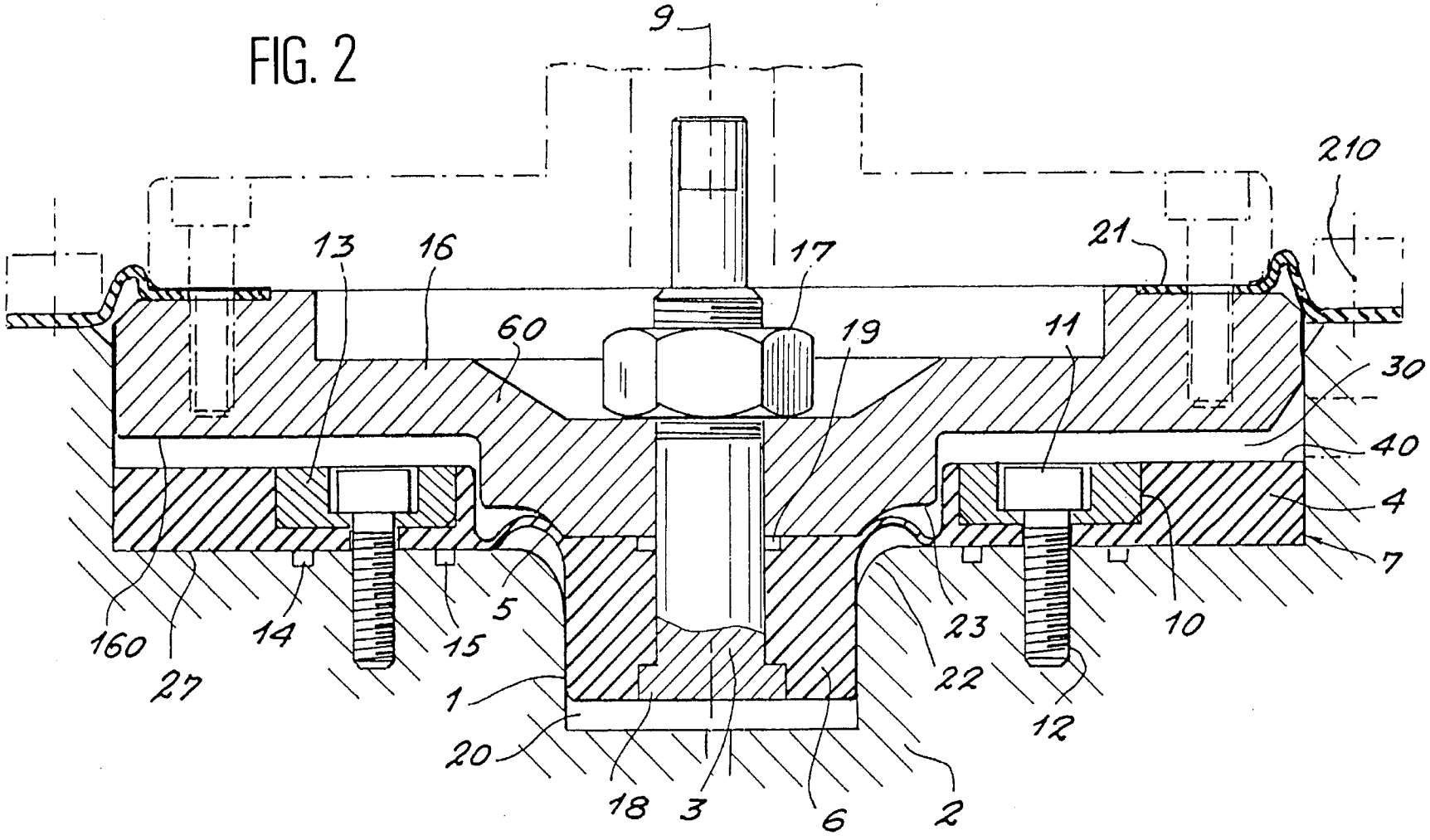

The cylindrical piston 6 is pierced with a central hole in which there is fixedly housed a rod 3 that has to be coupled to an element (not shown in the figure) for driving a piston in an alternating to-and-fro motion along the longitudinal axis 9 of said piston, with a permitted angular incidence. This movement of the piston, between an extreme low position defined by the bottom of the cavity and an extreme high position, demarcates a chamber 20 with variable volume, contained between the bottom of the cavity 1 and the base of the piston 6. FIG. 1 shows the pump according to the invention with the piston in a low position for which the volume of the chamber is the minimum and FIG. 2 shows this pump with the piston in the high position for which the volume is the maximum. A shoulder 18 on the rim of the base of the rod 3, facing the pump body 2, enables said rod to be fixedly joined to the piston 6, by means of a tightening nut 17. According to one variant of the invention, the rod 3 may be made of the same material as the single-piece set 7, in which case it is simply a projecting portion of the piston 6, outside the cavity 1 of the piston body 2. On its face 40 opposite the pump body 2, the ring 4 is hollowed out with an annular channel 10, the bottom of which is perforated at the level of the threaded holes 12 of the pump body, to enable the passage of fixing means such as screws 11 for example. A reinforcing annular flange 13 can be placed in the annular channel 10. This flange, which makes it possible to distribute the gripping forces of the screws 11 uniformly on the rim of the ring 4, is made necessary above all by the plasticity of the polyethylene tetrafluoride. This necessity can be removed when the single-piece set 7 is made of metal, for example steel or electroplated nickel.

In a first embodiment described by FIGS. 1 and 2, the thinned part 5 which connects the upper rim 64 of the piston 6 to the internal circumference of the ring 4, is flexible and deformable and its initial shape, when the piston is in the low position, perfectly matches the neck 22 of the cavity 1, this neck 22 being slightly rounded in the figures. Its value arises out of its capacity to be deformed while following the motion of the piston 6 while the ring 4 remains fixedly joined to the pump body 2. When the piston is in a low position, the thinned part reduces the idle volume of the chamber 20 to the minimum, thus increasing the compression rate of the pump. When the piston is in the high position as can be seen in FIG. 2, the part 5 which acts as a diaphragm of a standard pump gets deformed but works essentially under deflection and almost never under traction. This increases its lifetime.

The imperviousness of the chamber 20 with variable volume can be ensured by a sealing compound deposited between firstly the faces that are before the pump body 2 and, secondly, the single-piece set 7, or by a peripheral thread of the ring 4 provided with an oil-proof seal. In the example of FIGS. 1 and 2, the imperviousness is provided by two concentric circular ribs 14 and 15, that are positioned about the cavity 1, on the face 27 of the pump body 2 and that can be made according to two embodiments.

In the first embodiment, said ribs are in the form of grooves hollowed out in the pump body 2, under the ring 4 and at the level of the reinforcing flange 13. An O-ring seal placed in each of the grooves ensures the sealing of the chamber with variable volume demarcated by the cavity 1 of the pump body 2, the piston 6 and the thinned part 5 of the single-piece set 7.

In a second embodiment, said ribs are embossed on the face 27 of the pump body 2 or on the face 40 of the ring 4, facing the pump body, at the flange 13. When the flange 13 is being tightened by means of the screws 11, the ribs 14 and 15 bite into either the face 27 of the pump body or the face 40 of the ring 4 by very close contact and provide for the sealing of the same chamber with variable volume.

According to the invention, it is possible to create a second chamber 30 with variable volume by placing a circular disk 16 on the single-piece set 7, said circular disk 16 having the same diameter as the set 7 and being pierced with a hole at its center for the passage of the rod 3. This second chamber 30 is created between the single-piece set 7 and the disk 16. In the example of FIG. 1, the face 160 of this disk 16, facing the set 7, has a shape complementary to that of said set 7, i.e. it has a central part forming a second piston 60 that is coaxial with the first one. The rounded neck 23 of of this second piston, in contact with the thinned part 5, has a profile capable of permanently supporting the tip of the convexity of the said part 5 during the movement of the piston 6. Indeed, the part 5 participates in the task of compression of the fluid to ensure that it flows along the generatrices of the cylinders forming the piston 6 and the tip of the convexity of the part 5 is then, at any time, the flimsiest part for it is subjected simultaneously to a bending stress and to the stress of the pressure differential between its face that is before the piston 6 and its face that is before the piston 60. The essential part of the work of compression is done by the base of the piston 6. The shape of the disk 16 thus defined has the additional advantage of perfectly matching the thinned part 5 when the piston 6, hence the disk 16, are in the low position, thus reducing the idle volume under compression of the second chamber 30 with variable volume. The imperviousness of the second chamber 30 is ensured in a standard way by a diaphragm 21 that is fixed, on the one hand, to the disk 16 and, on the other hand, to the pump body 2, by means of a clamp 210 for example. A plate 201 is positioned on the diaphragm 21 to ensure the mechanical strength of the set. Each of the chambers 20 and 30 with variable volume communicates with the fluid circuit for which the pump according to the invention is designed, by means of its valves housed in cavities $C_{26}$ shown in FIG. 5 which shall be described here below.

Figure 3:
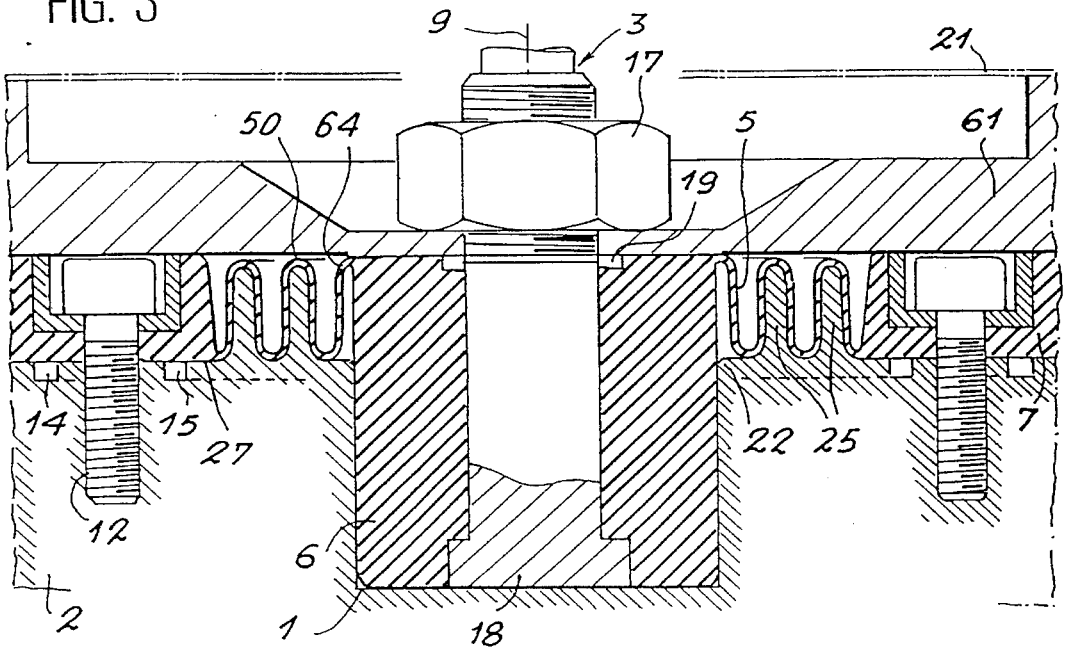
FIGS. 3 and 4 are cross-sectional views of a second embodiment of a pump according to the invention, for the two extreme positions of the piston.
Figure 4:
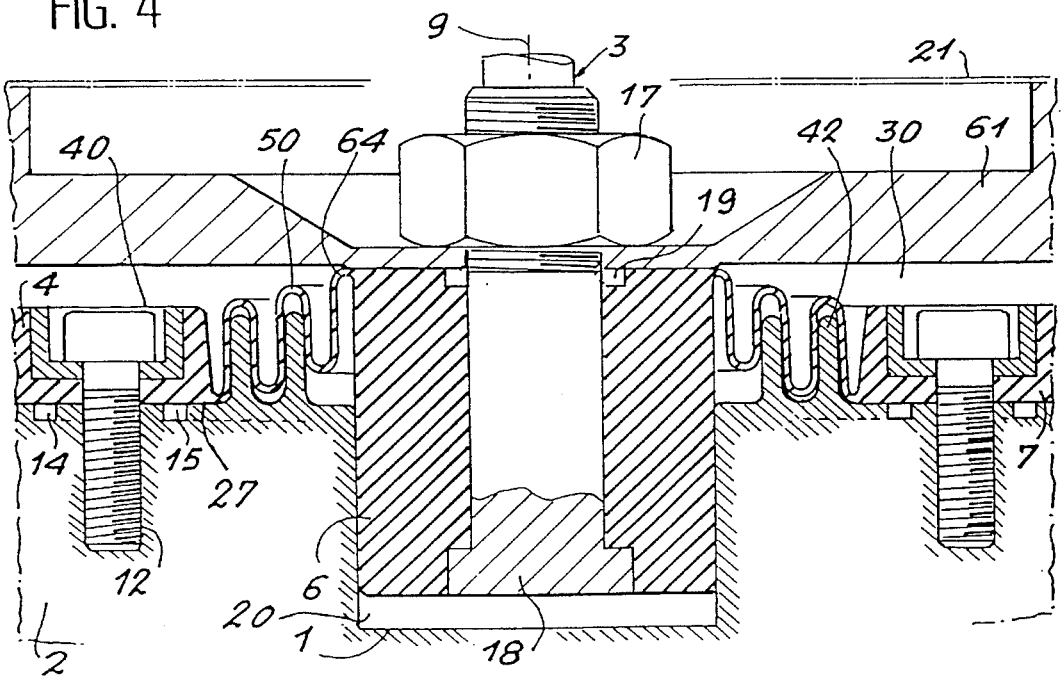

In the second embodiment of a sealed piston pump according to the invention, described in FIGS. 3 and 4, the thinned part 5 of the single-piece set 7 comprises at least two folds 50 between the rim 64 of the piston 6 and the ring 4, these folds 50 being concentric with the axis 9 of the piston 6. During the movement of the piston 6, the deformation of the part 5 is achieved by the winding of material. The advantage provided by these folds 50, which are parallel to the axis 9 of the piston and hence to the axis of its shift, lies in the tolerance of the angular variations of the movement of the piston, owing to the great flexibility of the part 5 that is thus folded. The face 27 of the pump body is provided with humps 25 equal in number to the number of folds 50 and having an appropriate shape that enables it to be fitted entirely into the folds so as to minimize the idle volume under compression when the piston is in the low position: an idle volume does not participate in the compression of the fluid for it does not cause any movement of the piston. Furthermore, these humps 25 support and guide the thinned part 5 when the piston is moved, during the operation of the pump. When the pump has to have two chambers with variable volume, it has an additional disk 61 placed on the single-piece set 7, the face of this disk 61 that is before the set 7 being flat and hence easy to make.

Figure 5:
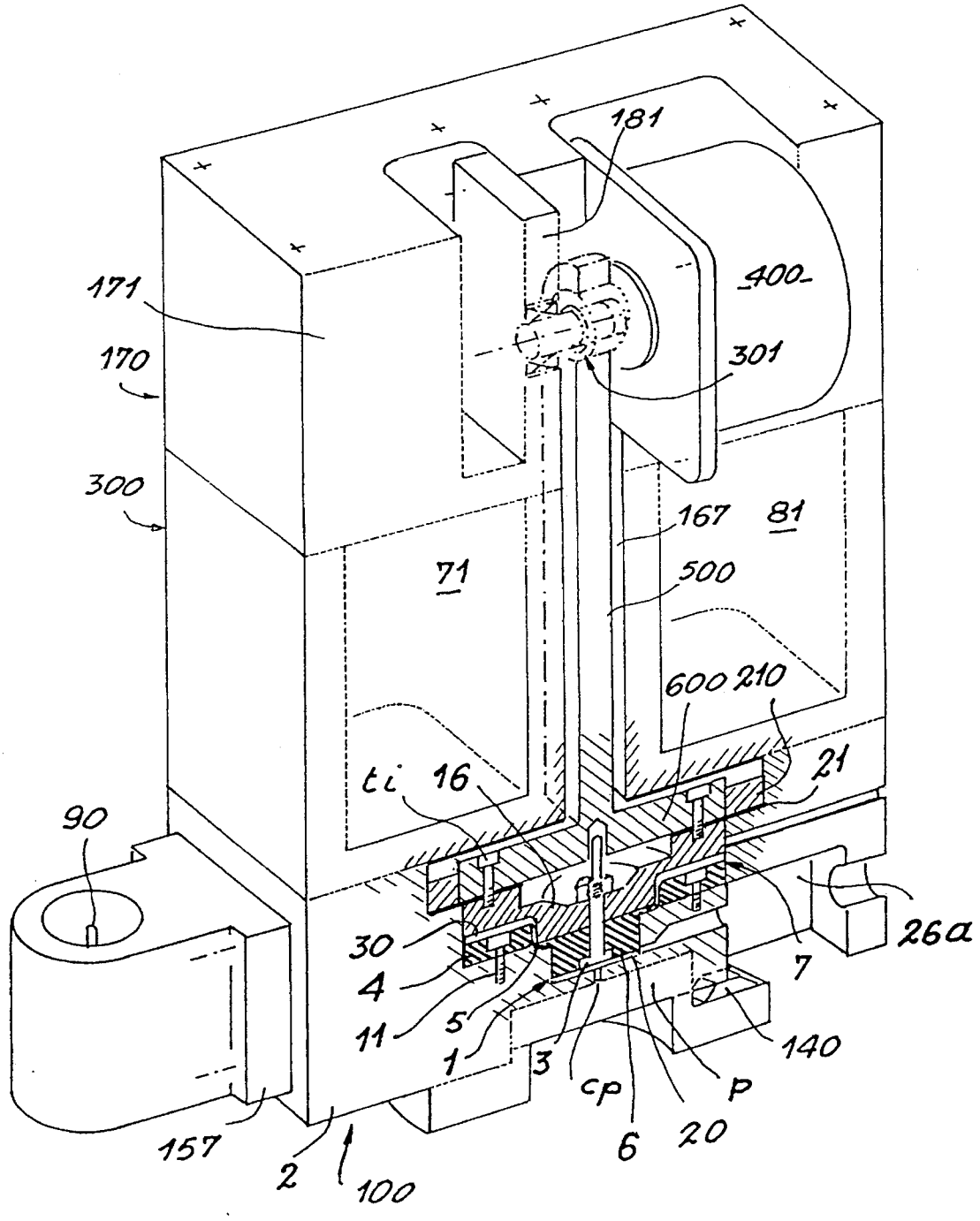
FIG. 5 shows a sectional, perspective view of the pump according to the invention, integrated into an ink supply circuit.

This type of pump according to the invention is especially well suited to the conveying of multiple-phase fluids between different containers with precise control being achieved over their pressures, notably in ink-supply circuits for ink-jet printers such as the one shown in FIG. 5. This figure is a perspective view in longitudinal section of the pump according to the invention, integrated into a supply circuit of an ink-jet printing head, as described in the French patent number 2 624 795 filed on behalf of the Applicant. The sealed pump according to the invention is located in the bottom part of a device designed to receive a combination of chambers with variable volume. This pump works together with a container unit 300. It is placed in a device 100 constituted by a monolithic massive block in which there are the following cavities: first of all, the cavity 1 of the pump body 2 in which there moves the piston 6 which, combined with the thinned part 5 of the single-piece set 7, demarcates the chamber 20 with variable volume, then the second chamber 30 with variable volume between the disk 16 and the single-piece set 7 and a plurality of cavities $C_{26a}$ called radial cavities, having the same shape and the same internal volume, arranged in a star formation on the periphery of the chambers 20 and 30. Through this arrangement, the chamber 20 has an idle volume that is as small as possible, and this leads to a high compression rate. A conduit $C_p$ places a pressure sensor P in communication with the chamber 20 with variable volume. A flange holds this sensor P in position and has sections 140 used as supports for the electromagnetic valves designed to be housed in the cavities $C_{26a}$. A set of screws going through the holes $t_i$ keeps the ring 4 and the flange 210 which respectively clamp the thinned part 5 and the diaphragm 21. The piston 6 is connected by means of the base 600 to a link-rod 500 connected by means of a cam 301 supported by a bearing 181 to a motor borne by a motor support 171. The single-piece container unit 300 is positioned between the motor unit 170 and the pump, and has two compartments that fulfil the function of an ink-recovery vessel 71 and an ink-collection vessel 81, and a passage 167 that goes through the link-rod 500. On the sides of the pump, there are positioned cartridge-holders 157, receiving cartridges of ink and solvent that are needed for the working of the printer and are detachable. The ink is taken at a trocar 90 whose function is to penetrate a diaphragm designed for this purpose in the cartridge.

It is also possible to envisage other applications through the possible miniaturization of such a pump. Thus, by activating the piston with a piezo-electrical or electromagnetic element, a pump such as this can be integrated into an ink-jet printing head.

What is claimed is:

1. A sealed piston pump comprising a pump body with an open cavity hollowed out in the center of a face of the pump body, at least two holes being pierced on said face, wherein said sealed piston pump furthermore comprises a circular single-piece set formed by:

a central cylindrical piston having dimensions substantially equal to those of said cavity, coupled by means of a rod to a driving member that works in an alternating motion along its longitudinal axis, in said cavity between a low position defined by the bottom of the cavity and a high position defining a chamber with variable volume;

a ring, having dimensions substantially equal to those of the face of said pump body, there being positioned and hollowed, on a face of the ring opposite said pump body, an annular channel whose bottom is perforated at the position of the holes of the pump body;

a deformable thinned part, connecting an upper rim of said piston to the internal circumference of said ring and perfectly matching the shape of the neck of said cavity when the piston is in the low position; and wherein said pump body and said single-piece set are fixedly joined in an imperviously sealed way.

2. A pump according to claim 1, wherein said single-piece set is made of a synthetic material that is flexible and mechanically and chemically resistant.

3. A pump according to claim 2, wherein said single-piece set is obtained by molding and thermocompression of powders such as polyethylene tetrafluoride.

4. A pump according to claim 1, wherein said piston is perforated with a central hole in which the rod is placed, said rod having a shoulder on a rim of a base of the rod facing said pump body, and wherein a tightening nut fixedly joins said rod to said piston imperviously by means of an O-ring seal.

5. A pump according to claim 1, wherein two ribs are hollowed out in the form of grooves in said pump body and are used as a housing for two O-ring seals.

6. A pump according to claim 5, wherein said ribs are embossed on the face of said pump body.

7. A pump according to claim 1, wherein a sealing compound is placed between two adjacent faces of said pump body and said single-piece set.

8. A pump according to claim 4, further comprising:

a disk pierced with a central hole into which there is fitted said rod that is positioned on the face of the ring opposite said pump body and that is fixedly joined to said piston in an imperviously fixed way by the O-ring seal and by the tightening nut placed about said rod, so as to form a second chamber with a variable volume between the face of the ring and the disk;

a diaphragm fixed by a reinforcement flange both to a face of said disk opposite said single-piece set and to said pump body.

9. A pump according to either of the claims 1 or 2, wherein the thinned part of said single-piece set comprises at least two folds, between the rim of said piston and said ring, that are concentric to the axis of said piston and wherein the face of said pump body is provided with humps, equal in number to the number of the folds, the volume of these humps totally filling the folds in order to minimize the idle volume in compression when said piston is in a low position.

10. A pump according to claim 9, furthermore comprising a disk positioned on the face of the ring opposite said pump body, pierced with a central hole into which the rod gets engaged, a face of this disk adjacent said single-piece set being flat.

* * * * *